US005340609A

United States Patent [19]

Arthur et al.

[11] Patent Number: 5,340,609

[45] Date of Patent: Aug. 23, 1994

[54] APPLYING FLUID ADDITIVE TO FIBROUS MATERIAL

[75] Inventors: Hugh M. Arthur, Bucks, England; Francis A. M. Labbe, Neuilly-sur-Seine, France

[73] Assignee: Molins plc, Bucks, England

[21] Appl. No.: 496,108

[22] Filed: Mar. 16, 1990

Related U.S. Application Data

[60] Continuation of Ser. No. 20,887, Mar. 2, 1987, abandoned, which is a division of Ser. No. 328,625, Dec. 8, 1981, Pat. No. 4,646,675.

[30] Foreign Application Priority Data

Dec. 12, 1980 [GB] United Kingdom ..... 8039930

[51] Int. Cl.[5] ..... B05D 5/00

[52] U.S. Cl. ..... 429/244; 8/149.1; 8/477; 28/283; 68/200; 118/63; 118/65; 118/325; 118/326; 118/407; 118/410; 118/415; 131/79; 427/175; 427/373

[58] Field of Search ..... 118/63, 65, 325, 326, 118/407, 410, 415; 427/175, 244, 373; 68/200; 8/149.1, 477; 28/283; 131/79

[56] References Cited

U.S. PATENT DOCUMENTS

| | | | |
|---|---|---|---|
| 2,617,426 | 11/1952 | Patterson | 131/79 X |
| 2,966,198 | 12/1960 | Wylde | 118/325 X |
| 3,769,883 | 11/1973 | Greve | 28/283 X |
| 3,865,078 | 2/1975 | De Howitt et al. | 118/411 X |
| 4,023,526 | 5/1977 | Ashmus et al. | 8/477 X |
| 4,367,249 | 1/1983 | Bloom et al. | 118/326 X |
| 4,619,276 | 10/1986 | Albertson et al. | 131/79 |
| 4,756,316 | 7/1988 | Keritsis | 131/94 |

FOREIGN PATENT DOCUMENTS

| | | |
|---|---|---|
| 1475576 | 8/1973 | United Kingdom . |
| 1391403 | 4/1975 | United Kingdom . |
| 2018165 | 10/1979 | United Kingdom . |

OTHER PUBLICATIONS

Hawyley, G. G., *The Condensed Chemical Dictionary*, Ninth edition, New York, Van Nostrand Reinhold Company, 1977, pp. 288, 691.

*Primary Examiner*—Michael Lusignan

*Attorney, Agent, or Firm*—Antonelli, Terry, Stout & Kraus

[57] ABSTRACT

Air is blown into filter tow during or immediately after the application of plasticizer; this foams and distributes the plasticizer in the tow. Air may be delivered from a porous plate closely adjacent to the path of the tow or from nozzles in an air injecting unit. Alternatively air may be used to foam plasticizer at a location remote from the tow and foamed plasticizer subsequently conveyed to and into the tow by a roller.

54 Claims, 3 Drawing Sheets

APPLYING FLUID ADDITIVE TO FIBROUS MATERIAL

This application is a continuation of application Ser. No. 07/020,887, filed on Mar. 2, 1987, now abandoned, which is a Divisional of application Ser. No. 328,625, filed Dec. 8, 1981, now U.S. Pat. No. 4,646,675.

This invention relates to applying fluid additive to fibrous material, particularly in the production of filter rod for the tobacco industry.

Filter rods for making filters for attachment to tobacco lengths, to produce filter cigarettes, may be made by continuously forming a tow of filter material, e.g. cellulose acetate, into a rod in a rod forming machine, e.g. Molins PM5N. Conventionally a so-called plasticiser (commonly triacetin) is added to the tow before it is passed into the rod-forming device. When cured, the plasticiser improves the properties of the finished rod by hardening it. The plasticiser may also have filtering properties. It is usually desirable that the device which applies the plasticiser should distribute the plasticiser as evenly as possible throughout the tow.

According to one aspect the invention provides apparatus for applying fluid additive to a moving stream of fibrous material, comprising means for supplying an air flow towards and within said stream, and means for introducing fluid additive into said air flow, so that a mixture of air and fluid additive is distributed within said stream by said flow. Preferably said air flow supplying means and said fluid additive introducing means are arranged so that said mixture includes foamed fluid additive.

In a preferred arrangement the fibrous material is a tow of filter material and the fluid additive is plasticiser; without prejudice to its general application the invention will hereinafter be described with reference to filter tow and plasticiser.

Plasticiser may be supplied to the tow with or by the air or from a separate source. In one arrangement filter tow is moved past a spray device for spraying plasticiser at one side of the tow and air is directed into the tow from the other side of the tow. Preferably the air directing means is opposite the spray device and may not only improve distribution of plasticiser in the tow but also prevent passage of sprayed plasticiser beyond the tow, thereby improving the capture efficiency of the supplied plasticiser. The air directing means may comprise a porous plate in close proximity to or in sliding contact with the tow and through which air is blown into the tow.

Plasticiser may be supplied with the air by using the air flow to entrain plasticiser. Thus the tow may be moved through an annular orifice from which plasticiser-containing air is blown into the tow. The plasticiser may be in the form of droplets in the air stream until it reaches the tow, the fibres of which thereafter impede the passage of air and plasticiser such that a foam is produced in the tow.

Fibres of the tow may aid in the production of foam within the tow itself by reason of their movement relative to plasticiser. Flow of air in the tow distributes thin films of foamed plasticiser throughout the tow. Plasticiser may be foamed outside the tow for subsequent application to the tow. The plasticiser may be foamed by passing air through it as before and, in a preferred arrangement, by supplying liquid plasticiser to a porous plate through which air is blown. Where the foam is produced remote from the tow path it may be conveyed to the tow. The foam may be formed adjacent the tow path and simply allowed to spill over onto the tow, or it may be formed within the tow. Alternatively, a foamed plasticiser stream may be conveyed (for example by a rotating roller or the like) along a path which converges with the tow path so that the foam and tow coalesce. Distribution of plasticiser through the tow and the depth. of a conveyed foam stream may be controlled by the speed of conveyance and the flow of air.

Plasticiser may be supplied to a foaming device for application to or conveyance to the tow at the required total rate of application of plasticiser to the tow. Alternatively, only a proportion of the plasticiser may be foamed for application to the tow. In particular, a foamed layer of plasticiser in or on one surface of the tow is believed to create a barrier which prevents or tends to prevent passage completely through the tow of plasticiser sprayed from the other side of the tow. Thus, a relatively small amount of plasticiser may be supplied to a foaming device for creating this barrier whilst the majority of the plasticiser is supplied to a conventional spraying device.

A foaming agent could be added to the plasticiser, if desired, to increase or otherwise modify its foaming properties.

BRIEF DESCRIPTION OF THE DRAWING

The invention will be further described, by way of example only, with reference to the accompanying diagrammatic drawings, in which

FIG. 1 shows an applicator chamber 2 through which a tow 4 of filter material is drawn by a pair of rolls 5 before being formed into a filter rod in a machine such as the Molins PM5N. The tow 4 passes through the chamber 2 at a speed which is generally determined by the speed of the filter rod making machine (although variations in the relative speeds of the tow upstream of and in the rod making machine may be made to vary the quantity or density of tow in the filter rod). The tow 4 is supplied from a bale (not shown) as a continuous web of crimped filaments and passes through a tow opening unit in which it is stretched and transversely spread before reaching the chamber 2. At the chamber 2 the tow is typically 250 mm wide and 3–5 mm in thickness; the chamber may be about 300 mm wide and about 400 mm long.

Figure 1:
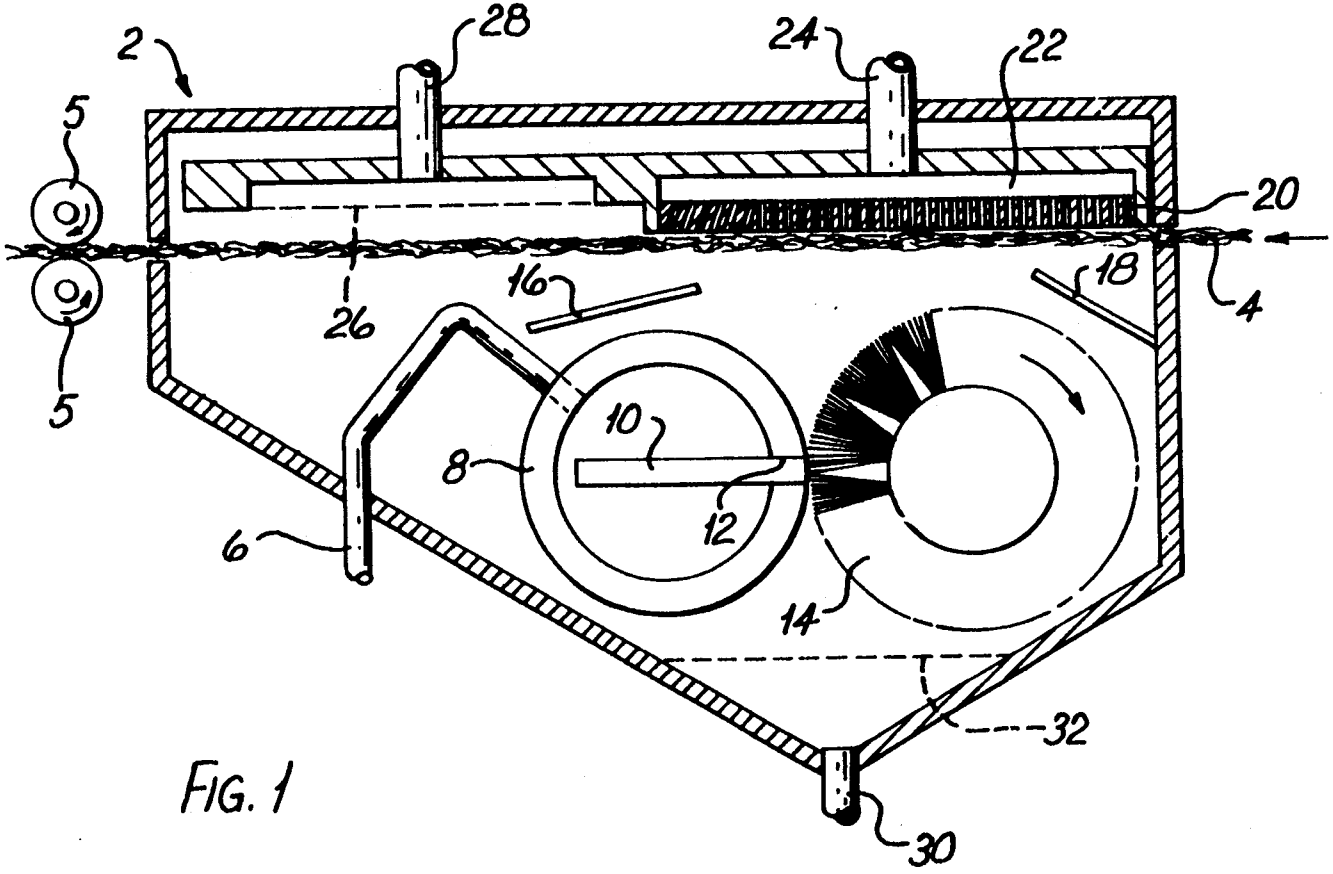
FIGS. 1, 2, 3 and 4 are sectional views of different arrangements for applying plasticiser to a tow of filter material.

Plasticiser is supplied to the chamber 2 at a predetermined rate through a pipe 6. A constant displacement pump driven at a rate dependent on the speed of the filter rod making machine (and/or in accordance with a measured quantity of material in or supplied to the filter rods themselves) may be used to supply plasticiser the pipe 6 from a supply tank (not shown). The pipe 6 delivers plasticiser into a hollow cylindrical manifold 8 which carries a strip 10 of porous material extending longitudinally of the manifold 8 and through a slot 12 in its surface. Plasticiser is transferred by the porous strip 10 to the outer surface of the manifold 8 and is continuously removed therefrom by rotating a brush 14. The brush 14 is rotated at a relatively high speed (e.g. 2,000 rpm) and its bristles pluck the plasticiser from the surface of the manifold 8 (and strip 10) and project it as fine droplets towards the passing tow 4. Baffles 16, 18 restrict the arc of the spray of droplets by intersection to that portion of the passing tow 4 opposite a porous plate 20 which forms the lower surface of a chamber 22 to which air may be delivered through a pipe 24.

In use, the tow 4 is preferably closely adjacent to or in sliding contact with the plate 20 and air exhausting from the chamber 22 through the plate and into the tow converts the plasticiser in the tow into a foam held within the tow. The fibrous nature of the tow 4 and its movement past the plate 20 aid in the creation of a foam. Generally, some of the plasticiser sprayed upwards by the brush 14 reaches the opposite (or upper) side of the tow so that the foam may be distributed across the tow by the air flowing through the plate 20. The pressure in the chamber 22 may be controlled so that the air flow through the plate 20 is correspondingly controlled to maintain an even distribution of foam in the tow.

Plasticiser on the upper side of the tow helps to lubricate passage of the tow 4 if sliding contact is maintained with the plate 20. Alternatively, or additionally, the air flow from the plate 20 may be sufficient to create an air bearing effect for the passing tow 4. If, nevertheless, the drag on the tow 4 is still significant, the plate 20 may be constructed so that air is directed from the chamber 22 with a forward component (as indicated at the left-hand side of the plate 20). For normal purposes, however, a suitable material for the plate 20 is a permeable high density polyethylene such as one of the range of materials manufactured under the VYON trade mark by Porvair Limited of Kings Lynn, Norfolk, England. VYON DM, for example, having a thickness of 20 mm and mean pore size of 0.06 mm and allowing an air flow of about 5 cu.m/m$^2$/min. at 4,000 Pa (0.6 psi), could be used. (VYON DM is also suitable for use as the strip 10.)

In order to provide the desired air flow through the plate 20 the pressure in the chamber 22 is maintained above that in the chamber 2. Typically the pressure differential is of the order of 2,000–6,000 Pa (0.3–1 psi). The air supplied through the pipe 24 to maintain pressure in the chamber 22 is preferably ionised to aid neutralisation of electrostatic charges which may build up within the chamber 2 and on the tow 4.

It is preferred to maintain pressure in the chamber 2 at or just below atmospheric pressure so that plasticiser loss in air leaking from the chamber is reduced. Controlled extraction of air from the chamber 2 is therefore provided by means of a pump (not shown) which draws air through a coarse screen 26 which captures tow fly (small fibrous particles of the tow which have been separated from the web), and into an exhaust pipe 28. Withdrawal of air through the pipe 28 may be controlled in response to a sensor for pressure in the chamber 2.

Plasticiser which is sprayed upwards by the brush but remains uncaptured by the tow 4, e.g. that intercepted by the baffles 16 and 18, may drain to the bottom of the chamber 2, from where it is returned to the supply through a drain pipe 30. A coarse sieve 32 is provided to remove tow fly from plasticiser which is returned to the supply.

Figure 2:
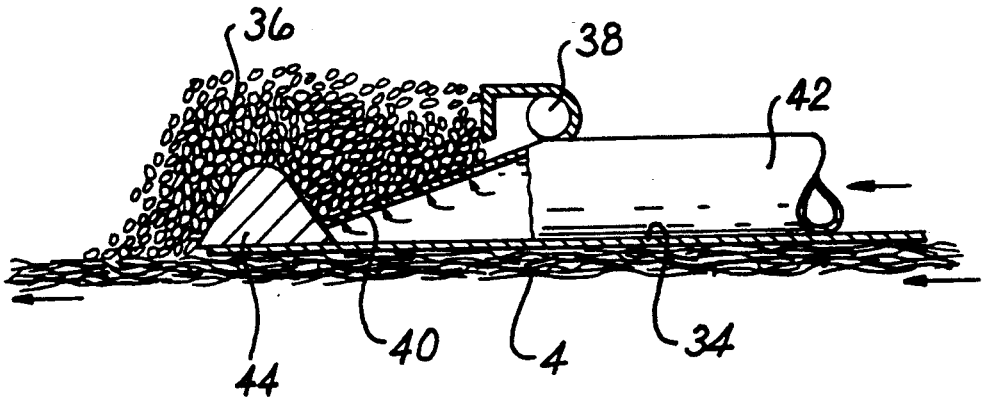

FIG. 2 shows a further arrangement for applying plasticiser to tow. The tow 4 passes beneath a guide surface 34 at one end of which foamed plasticiser 36 is introduced onto the upper surface of the tow. The foamed plasticiser 36 is formed by delivering plasticiser from a manifold 38 onto a porous plate 40 through which air is delivered from a pressure chamber 42. The foam forming region is defined between the manifold 38 and an obstruction 44 on the opposite edge of the plate 40. Foamed plasticiser 36 spills over the obstruction 44 and onto the upper surface of the tow 4. The rate of delivery of plasticiser in relation to the speed of the tow 4, is such that a relatively thin layer of foamed plasticiser is entrained on and/or in the upper layer of the tow 4.

The arrangement of FIG. 2 may be used as a supplementary plasticiser supply in conjunction with a main supply including means for spraying plasticiser at the under-surface of the tow 4. It is believed that, by supplying the upper foamed plasticiser layer at a position just upstream of the position at which the main supply of plasticiser is sprayed, those droplets, or the majority thereof, which would have penetrated through the tow will be prevented from so doing by the upper layer or skin of plasticiser-impregnated tow which will capture said droplets. Thus the filaments in the upper layer are linked by numerous thin films of plasticiser formed by the foaming process. Hence, the capture efficiency of the supplied plasticiser and its distribution through the tow may be improved.

In a preferred arrangement the apparatus of FIG. 2 may be positioned within a plasticiser applicator chamber, upstream of the main delivery region for plasticiser, and conveniently at or near the entrance to the chamber for the tow. Thus, the FIG. 2 arrangement may be incorporated at or near the entrance of the booth 2 of the arrangement of British patent specification No. 2054342. Typically about 10% of the predetermined plasticiser supply could be delivered from the manifold 38, the remaining 90% being delivered by the main spray supply. The FIG. 2 arrangement could also be used in combination with the FIG. 1 arrangement, so that it would be just upstream of the plate 20.

Figure 3:
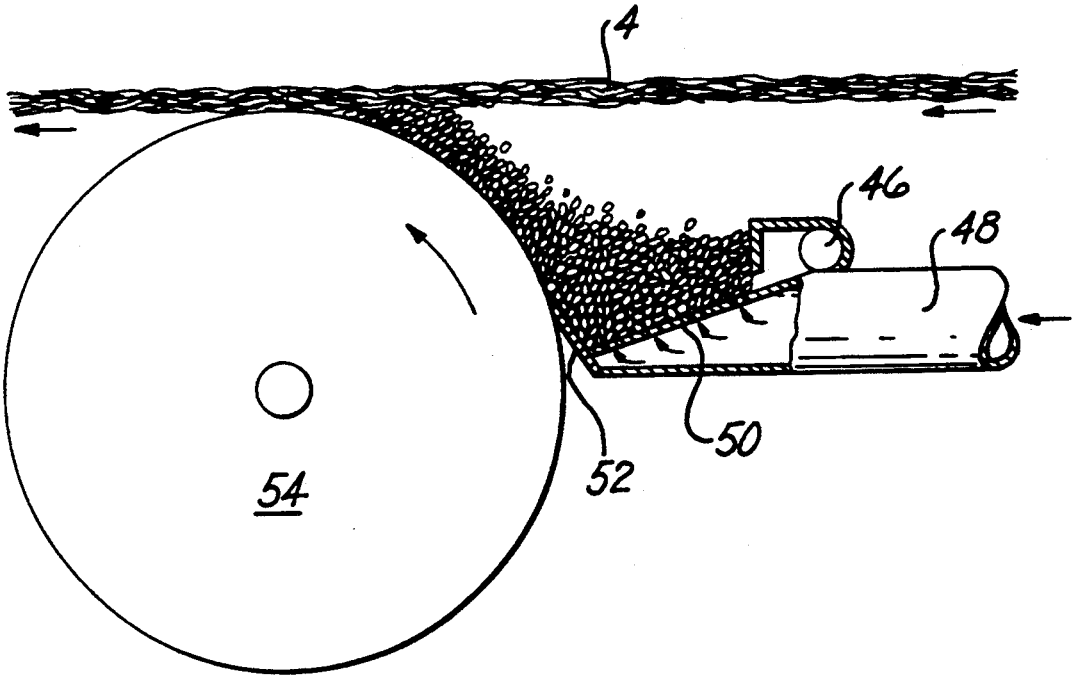

An alternative arrangement, in which the entire plasticiser supply is converted into a foamed layer, is shown in FIG. 3. The foaming device is similar to that of FIG. 2 and includes a plasticiser manifold 46, pressure chamber 48, and porous plate 50. Foamed plasticiser is formed between the manifold 46 and a barrier 52, the far end of which lies adjacent a rotatable roller 54 covered with a thin layer of relatively dense felt.

Plasticiser is supplied to the manifold 46 at the rate at which it is required to impregnate the tow 4. Air is supplied through the plate 50 and the roller 54 is rotated so as to maintain and transfer onto the roller a layer of foamed plasticiser sufficient to evenly impregnate the tow 4. The roller 54 may be rotated at a peripheral speed approximately equal to the speed of the tow and a layer of foamed plasticiser of about the same thickness as the tow may be delivered to the tow 4 at the top of the roller 54 so that the tow and foam coalesce, as indicated in the drawing. However, the roller 54 could be rotated more slowly to convey and transfer a rather thicker layer of foam. In general, the distribution of the plasticiser across the tow 4 may be controlled by the quantity of air supplied through the plate 50, the speed of the roller 54, and possibly the plasticiser temperature (which affects viscosity and hence "wettability" of the tow).

Figure 4:
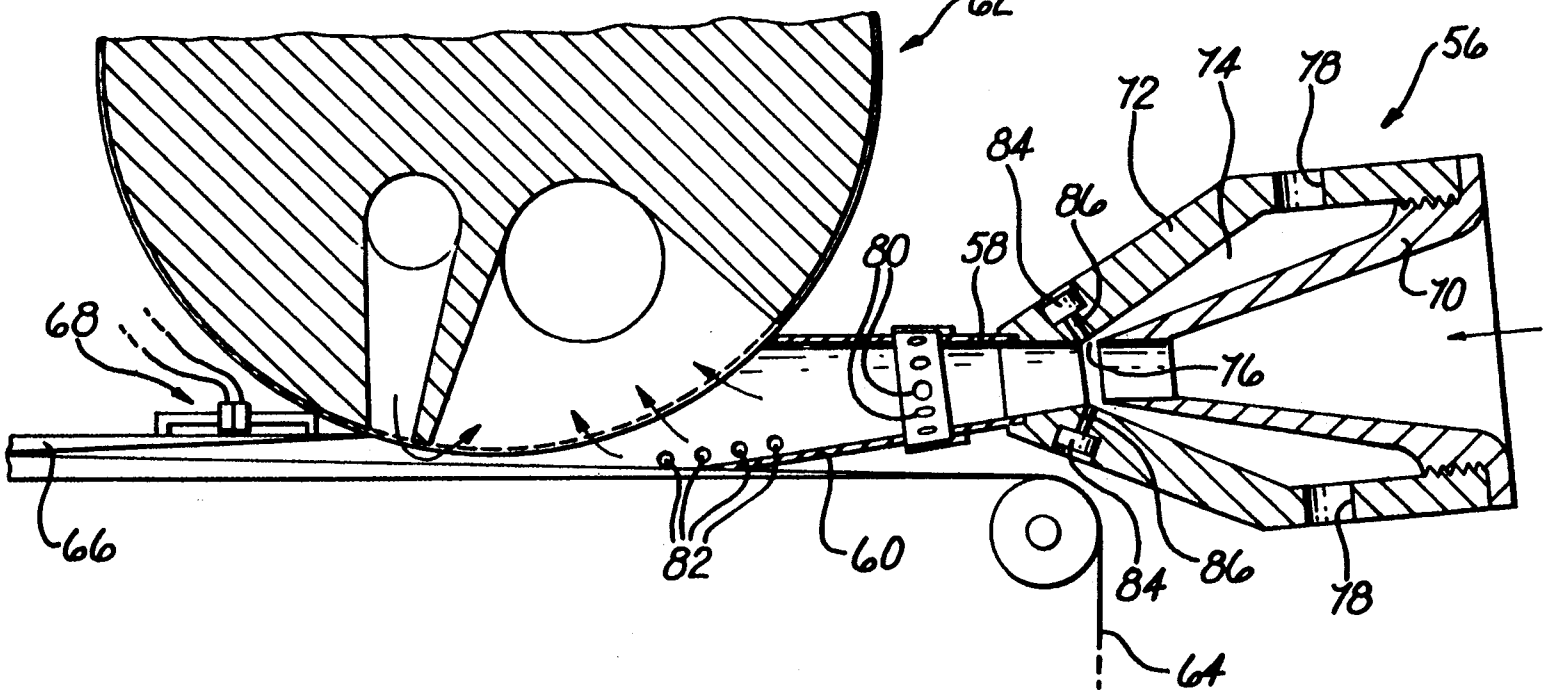

FIG. 4 shows an arrangement for introducing plasticiser to the tow at an upstream part of the rodmaking machine, i.e. downstream of the tow opening unit in which plasticiser is usually applied. The tow path from the tow opening unit passes (in the direction indicated) into a tow fluffing and injecting unit 56, through ducts 58, 60 and between a suction wheel 62 and wrapper web 64. Subsequently the compressed tow passes underneath a tongue 66 (provided with a pressure sensing device 68) and into the rod forming and sealing part of the machine.

The unit 56 comprises a conical inner part 70 and a surrounding outer part 72 which defines with the inner part an annular space 74 having an annular outlet 76. Compressed air is applied to the space 74 through inlets 78 to produce an annular flow of air inwards into the tow through the outlet 76, e.g. at a flow rate of about 0.2 cu.m./min. This flow of air counters the tendency for the crimping of the tow to be removed by stretching during feeding into the filter rod making machine. Excess air thus entrained with the tow may be removed in a controlled manner by the suction wheel 62 and by air outlets 80, 82 between or in the ducts 58, 60.

For further details of the construction and operation of a device similar to that of FIG. 4 reference is directed to British patent specification No. 1588506.

The outer part 72 of the unit 56 includes an annular plasticiser manifold 84 provided with an annular passage or series of passages 86 leading to the air outlet 76. Plasticiser supplied to the manifold 84 is injected into the tow with the air passing through the outlet 76. The flow of air past the passages 86 could be used to aid supply of the plasticiser from the manifold 84 due to a Venturi effect. In any event the flow of air past the ends of passages 86 ensures atomisation of the plasticiser; foaming of the plasticiser within the tow may also take place, due particularly to the relative movement of plasticiser-entraining air and the tow. The high rate of flow of air which entrains the plasticiser, in particular its momentum, ensures full and even distribution of plasticiser throughout the tow.

In order to maintain a desired plasticiser distribution the atomisation at the manifold 84 and outlets 86 should be controlled. In particular the size of the atomised droplets is important. One factor which is important in this respect is viscosity of the plasticiser. As this can vary considerably with temperature means may be provided for maintaining and supplying to the manifold 84 plasticiser at a constant temperature.

A unit 56, provided with plasticiser supply means 84, 86 could be used without the suction wheel 62 to withdraw air entrained in the tow, but in that case the supply rate of air would probably need to be reduced. By withdrawing air entrained in the tow a high air supply rate can be maintained to ensure adequate distribution of plasticiser in the tow. In the absence of air withdrawal means downstream of the unit 56 there is a risk that an air flow counter to the direction of tow movement will be produced if a high air supply rate is used; this would adversely affect the tow feed and distribution and could result in plasticiser loss.

Some or all of the plasticiser required to be impregnated in the tow could be supplied by the tow fluffing unit 56. If only a proportion of the total plasticiser supply is provided by the unit 56 the remainder may be supplied by arrangements as depicted in FIG. 1, 2 or 3, or otherwise.

Although the arrangements described with reference to the drawings have been concerned with the application of plasticiser to substantially continuous tows of fibrous materials the use of air to supply plasticiser to and to distribute plasticiser within fibrous materials (especially as a foam) is not limited to fibrous materials in this form. For example a stream of fibrous material including relatively short lengths of fibres could be supplied with plasticiser (or other fluid addictive) in this way.

We claim:

1. A method of producing rod-like articles of the tobacco industry from a stream of fibrous material, including applying fluid additive to a moving stream of fibrous material to be formed into said rod-like articles, said moving stream having a thickness, comprising the steps of forming an air flow, introducing fluid additive to said air flow, directing said air flow so that the air flow penetrates into a substantial part of the thickness of the stream of fibrous material and distributes foamed fluid additive within the substantial part of the thickness of the stream of fibrous material, the air flow being directed to have a forward component relative to a direction of flow of the moving stream of fibrous material, and distributing a mixture of air and fluid additive within the stream of fibrous material to be formed into said rod-like articles, by said air flow, said mixture comprising foamed fluid additive, the mixture of air and fluid additive being distributed within the stream of fibrous material by said air flow such that the mixture penetrates into the stream of fibrous material, in the thickness direction, at least a substantial part of the thickness of the stream of fibrous material.

2. A method as claimed in claim 1, wherein the mixture is formed at a position spaced from said stream of fibrous material and is conveyed to said stream as a substantially continuous stream of foamed fluid additive.

3. A method as claimed in claim 1, including the step of forming a continuous rod from said stream after said mixture has been distributed within said stream.

4. A method as claimed in claim 1, wherein the mixture of air and fluid additive penetrates through substantially the entire thickness of the stream of fibrous material, in the thickness direction.

5. A method as claimed in claim 1, wherein the mixture of air and fluid additive penetrating into the stream of fibrous material includes said foamed fluid additive, the foamed fluid additive, while still in foamed condition, penetrating into the stream of fibrous material.

6. A method as claimed in claim 1, wherein said air flow to distribute foamed fluid additive within the substantial part of the thickness of the stream of fibrous material is directed to one side only of the stream of fibrous material.

7. A method as claimed in claim 6, wherein the air flow distributes the foamed fluid additive from said one side only through substantially the entire thickness of the stream of fibrous material, in the thickness direction.

8. Apparatus for applying fluid additive to a stream of fibrous material moving along a path, comprising means for supplying an air flow towards and within said stream, and means for introducing fluid additive into said air flow, so that a mixture of air and fluid additive is distributed within said stream by said flow, the air flow supplying means including a mixing zone and means for supplying an air stream, said mixing zone including a junction between the air stream supplying means and the means for introducing fluid additive, the mixing zone being spaced from said path, and the air flow supplying means including means for conveying a mixture of air and fluid additive, the conveying means including an obstruction for said mixture, said obstruction being located at a position beyond which said mixture spills toward the stream of fibrous material moving along the path.

9. A method of manufacturing rod-like articles of the tobacco industry, comprising providing a moving stream of fibrous material for forming said rod-like articles of the tobacco industry; producing a liquid additive foam; and applying the liquid additive foam to said moving stream of fibrous material in a stream such that liquid additive foam is supplied to the interior of the moving stream of fibrous material, the liquid additive foam being applied in a direction substantially parallel to the direction of movement of the moving stream of filter material.

10. A method as claimed in claim 9, further comprising forming a rod from said moving stream to which liquid additive foam has been applied.

11. A method of producing a cigarette filter rod, comprising the steps of:

providing a moving stream of filamentary filter material;

applying a liquid additive foam to said moving stream of filter material, the liquid additive foam being applied in a direction substantially parallel to the direction of movement of the moving stream of filter material; and gathering said moving stream of filter material after the applying step, to form said cigarette filter rod.

12. A method as claimed in claim 11, wherein the filter material is cellulose acetate tow.

13. A method as claimed in claim 11, wherein the liquid additive foam comprises a plasticiser.

14. In a method for producing a cigarette filter rod, including the steps of providing a moving stream of filamentary filter material, spreading out the filter material in the moving stream, gathering the spread-out filter material to form the cigarette filter rod, and providing an outer layer for said cigarette filter rod, the additional step of:

applying a liquid additive foam to the moving stream of filter material after the beginning of the step of spreading out the filter material and before completion of the gathering step, at least part of the step of applying a liquid additive foam being carried out during the gathering step.

15. A method as claimed in claim 14, wherein part of said applying step is carried out before beginning the gathering step.

16. A method as claimed in claim 14, wherein said applying step is carried out during the gathering step.

17. A method of producing rod-like articles of the tobacco industry, comprising the steps of conveying fibrous material for forming said rod-like articles along a first path, conveying foamed fluid additive along a second path, the first and second paths converging with each other, and transferring foamed fluid additive to the fibrous material by conveying said foamed fluid additive and said fibrous material along portions of said first and second paths which converge with each other, wherein said first and second paths are adjacent and have generally similar directions prior to said transferring step, so that said paths converge progressively.

18. A method as claimed in claim 17, including the further step of producing said foamed fluid additive conveyed along the second path.

19. A method as claimed in claim 18, wherein the fibrous material and foamed fluid additive are conveyed respectively along the first and second paths at substantially the same speed.

20. A method of applying liquid additive to fibrous material for rod-like articles of the tobacco industry, in which the liquid additive is applied as a foam, wherein each portion of the fibrous material to which the liquid additive is applied receives a small uniform portion of said additive, comprising the steps of conveying successive portions of said fibrous material along a first path, conveying successive portions of a foam containing said liquid additive along a second path, the first and second paths converging with each other and applying said foam to said fibrous material by progressively transferring said foam to said fibrous material by conveying said fibrous material and said foam along portions of said first and second paths which converge.

21. A method as claimed in claim 20, including the further step of producing said foam containing said liquid additive, successive portions of which foam are conveyed along the second path.

22. A method as claimed in claim 20, wherein, in applying the foam to the fibrous material, the fibrous material and the foam are conveyed along portions of the first and second paths which converge at substantially similar speeds.

23. A method as claimed in claim 20, wherein the successive portions of the fibrous material conveyed along the first path, and the successive portions of the foam conveyed along the second path, are conveyed continuously, in a stream.

24. Apparatus for applying liquid additive to fibrous material for rod-like articles of the tobacco industry, comprising first means for conveying fibrous material along a first path, and second means for conveying a foam containing the liquid additive along a second path, the first and second paths converging with each other, said first and second means being arranged so that said foam is applied to said fibrous material when said first and second paths converge, wherein said first and second means are arranged to convey said fibrous material and said foam respectively in similar directions and so that said first and second paths converge progressively, whereby successive portions of fibrous material receive successive portions of substantially uniform quantities of said foam.

25. Apparatus as claimed in claim 24, further comprising means for producing said foam, conveyed along the second path, from the liquid additive.

26. Apparatus as claimed in claim 24, wherein the first and second conveying means are arranged so that the foam is applied to the fibrous material while the fibrous material and the foam are moving at substantially the same speed.

27. Apparatus for applying fluid additive to a stream of fibrous material moving along a path, comprising means for supplying an air flow towards and within said stream, and means for introducing fluid additive into said air flow, so that a mixture of air and fluid additive is distributed within said stream by said flow, the air flow supplying means including a mixing zone and means for supplying an air stream, said mixing zone including a junction between said air stream supplying means and said means for introducing fluid additive, said mixing zone being spaced from said path, and said air flow supplying means including means for conveying a mixture of air and fluid additive, said conveying means having an endless conveying surface for a stream of said mixture of fluid additive and air.

28. A method of producing rod-like articles of the tobacco industry, the rod-like articles containing a fibrous material, in which method a liquid additive is applied to the fibrous material as a foam, wherein each portion of the fibrous material to which the liquid additive is applied receives a small uniform portion of said additive, comprising the steps of conveying successive portions of said fibrous material along a first path, conveying successive portions of a foam containing said liquid additive along a second path, the first and second paths converging with each other, and applying said foam to said fibrous material by progressively transferring said foam to said fibrous material by conveying said fibrous material and said foam along portions of said first and second paths which converge.

29. A method of producing rod-like articles as claimed in claim 28, further including the step of forming the rod-like articles, so as to contain the fibrous material.

30. A method of producing rod-like articles as claimed in claim 28, including the further step of producing said foam containing said liquid additive, successive portions of which foam are conveyed along the second path.

31. A method of producing rod-like articles as claimed in claim 28, wherein, in applying the foam to the fibrous material, the fibrous material and the foam are conveyed along portions of the first and second paths which converge at substantially similar speeds.

32. A method of producing rod-like articles as claimed in claim 28, wherein the successive portions of the fibrous material conveyed along the first path, and the successive portions of the foam conveyed along the second path, are conveyed continuously, in a stream.

33. A method of producing rod-like articles as claimed in claim 29, wherein the step of forming the rod-like articles is performed after the step of applying said foam to said fibrous material.

34. Apparatus for producing rod-like articles of the tobacco industry, the rod-like articles containing a fibrous material, comprising first means for conveying the fibrous material along a first path, and second means for conveying a foam containing the liquid additive along a second path, the first and second paths converging with each other, wherein said first and second means are arranged to convey said fibrous material and said foam respectively in similar directions and so that said first and second paths converge progressively, said first and second means being arranged so that said foam is applied to said fibrous material when said first and second paths converge, whereby successive portions of the fibrous material receive successive portions of substantially uniform quantities of said foam.

35. Apparatus for producing rod-like articles of the tobacco industry according to claim 34, further comprising means for forming the rod-like articles containing the fibrous material.

36. Apparatus for producing rod-like articles of the tobacco industry as claimed in claim 34, further comprising means for producing said foam, conveyed along the second path, from the liquid additive.

37. Apparatus for producing rod-like articles of the tobacco industry as claimed in claim 34, wherein the first and second conveying means are arranged so that the foam is applied to the fibrous material while the fibrous material and the foam are moving at substantially the same speed.

38. Apparatus for producing rod-like articles of the tobacco industry according to claim 35, wherein the means for forming the rod-like articles is located, relative to the first and second means, such that said foam is applied to the fibrous material prior to forming the fibrous material into rod-like article.

39. A method of producing rod-like articles of the tobacco industry, the rod-like articles containing fibrous material, comprising the steps of conveying the fibrous material along a first path, conveying foamed fluid additive along a second path, the first and second paths converging with each other, and transferring foamed fluid additive to the fibrous material by conveying said foamed fluid additive and said fibrous material along portions of said first and second paths which converge with each other.

40. A method as claimed in claim 39, including the further step of producing said foamed fluid additive conveyed along the second path.

41. A method as claimed in claim 39, wherein said first and second paths are adjacent and have generally similar directions prior to said transferring step, so that said paths converge progressively.

42. A method as claimed in claim 40, wherein the fibrous material and foamed fluid additive are conveyed respectively along the first and second paths at substantially the same speed.

43. Apparatus for producing rod-like articles of the tobacco industry, the rod-like articles containing fibrous material comprising means for conveying the fibrous material along a first path, and means for conveying a fluid additive foam along a second path, the first and second paths including portions that extend in generally similar directions that converge progressively with each other, said respective conveying means being arranged so that said foam is applied to said fibrous material when said first and second paths converge.

44. Apparatus as claimed in claim 43, further comprising means for producing said fluid additive foam conveyed along the second path.

45. Apparatus as claimed in claim 44, wherein the respective conveying means are arranged so that the foam is applied to said fibrous material while said fibrous material and said foam are moving at substantially similar speeds.

46. Apparatus for the production of rod-like articles for the tobacco industry, including means to provide a moving stream of fibrous material for forming said rod-like articles, means for producing a liquid additive foam, means for applying the liquid additive foam to said moving stream of fibrous material, and a rod-forming device for forming rod-like articles from the stream, wherein the means for applying the liquid additive foam includes means for applying the liquid additive foam to the moving stream of fibrous material in a direction generally similar to the direction of movement of the moving stream of fibrous material.

47. In the manufacture of rod-like articles for the tobacco industry, the rod-like articles containing a fibrous material, the method which comprises:

providing a moving stream of fibrous material;

producing a liquid additive foam;

applying the liquid additive foam to said moving stream of fibrous material, and including the further steps of forming a flow or air, and directing the flow of air so that the flow of air penetrates a substantial part of a thickness of the moving stream of fibrous material and distributes liquid additive foam within the substantial part of the thickness of the moving stream of fibrous material, the flow of air being directed to have a forward component relative to a direction of flow of the moving stream of fibrous material, and wherein the liquid additive foam is applied to said moving stream of fibrous material by the flow of air, so as to penetrate into the moving stream of fibrous material to at least a substantial depth of the moving stream in a thickness direction.

48. Apparatus for the production of rod-like articles for the tobacco industry, including means for providing a moving stream of fibrous material for forming said rod-like articles, means for producing a liquid additive foam, means for applying the liquid additive foam to said moving stream of fibrous material, said liquid additive foam being applied to the fibrous material in a direction substantially parallel to the direction of movement of said material, and a rod-forming device for forming rod-like articles from the stream.

49. Apparatus for the production of rod-like articles for the tobacco industry, including means to provide a moving stream of fibrous material for forming said rod-like articles; means for producing a liquid additive foam; means for applying the liquid additive foam to said moving stream of fibrous material; and a rod-forming device for forming rod-like articles from the stream, the rod-forming device including means for supporting a moving wrapper for receiving the moving stream of fibrous material and subsequently enveloping it to form a rod, and including means for applying said liquid additive foam to the fibrous material as the fibrous material is being deposited on the wrapper.

50. Apparatus for the production of rod-like articles for the tobacco industry, including means for providing a moving stream of fibrous material for forming said rod-like articles, means for producing a liquid additive foam, means for applying the liquid additive foam to said moving stream of fibrous material, said applying means including means for conveying foam so that it reaches the interior of said moving stream of fibrous material, said applying means including means for applying a stream of liquid additive foam in a direction generally similar to that of said moving stream of fibrous material and for combining said streams, and a rod-forming device for forming rod-like articles from the stream.

51. A method of producing rod-like articles of the tobacco industry, the rod-like articles containing fibrous material, comprising the steps of conveying the fibrous material along a first path, conveying foamed fluid additive along a second path, the first and second paths having portions which are adjacent and extend in generally similar directions, and transferring foamed fluid additive to the fibrous material by conveying said foamed fluid additive and said fibrous material along further portions of said first and second paths which are at least partly coincident.

52. Apparatus for producing rod-like articles of the tobacco industry, the rod-like articles containing fibrous material, comprising means for conveying the fibrous material along a first path, and means for conveying a fluid additive foam along a second path, the first and second paths having portions which extend in generally similar directions and further portions where said paths are at least partly coincident, and means for transferring foamed fluid additive to the fibrous material by conveying said foamed fluid additive and said fibrous material on the coincident further portions of said first and second paths.

53. A method of producing rod-like articles of the tobacco industry from a stream of fibrous material, including applying fluid additive to a moving stream of fibrous material to be formed into said rod-like articles, said moving stream having a thickness, comprising the steps of forming an air flow, introducing fluid additive to said air flow, directing said air flow so that the air flow penetrates into a substantial part of the thickness of the stream of fibrous material and distributes foamed fluid additive within the substantial part of the thickness of the stream of fibrous material, distributing a mixture of air and fluid additive within the stream of fibrous material, to be formed into said rod-like articles by said air flow, said mixture comprising foamed fluid additive, the mixture of air and fluid additive being distribution within the stream of fibrous material by said air flow such that the mixture penetrates into the stream of fibrous material, in the thickness direction, at least a substantial part of the thickness of the stream of fibrous material, and supplying further fluid additive, not in a foamed condition, to the stream of fibrous material, at a location spaced from the location where the mixture of air and fluid additive, including foamed fluid additive, is distributed within the stream of fibrous material.

54. Apparatus for applying fluid additive to a stream of fibrous material moving along a path, comprising means for supplying an air flow towards and within said stream, and means for introducing fluid additive into said air flow in a mixing zone, so that a mixture of air and fluid additive is distributed within said stream by said flow, said mixing zone being on said path within said stream of fibrous material, the supply means and the introducing means being arranged so that the air flow and fluid additive at least initially have substantial components of movement in opposite directions in said mixing zone, further including means for delivering a stream comprising a mixture of air and fluid additive to part of said stream of fibrous material on said path.

* * * * *